United States Patent [19]

Hochman

[11] 3,939,985

[45] Feb. 24, 1976

[54] HOOK DISPLAY ASSEMBLY

[75] Inventor: Arthur Hochman, Union City, N.J.

[73] Assignee: Art-Phyl Creations, Newark, N.J.

[22] Filed: June 18, 1974

[21] Appl. No.: 480,344

[52] U.S. Cl. ..... 211/57; 248/DIG. 3

[51] Int. Cl.[2] ..... A47F 7/00

[58] Field of Search ..... 211/7, 54, 57, 59, 94; 248/DIG. 3, 223, 302, 303

[56] References Cited

UNITED STATES PATENTS

| | | | |
|---|---|---|---|
| 797,685 | 8/1905 | Harris | 211/59 X |
| 810,829 | 1/1906 | Ward | 211/59 |
| 1,117,248 | 11/1914 | Rosen | 248/223 X |
| 1,149,691 | 8/1915 | Seamans | 211/59 |
| 1,306,297 | 6/1919 | Auerochs | 211/59 X |
| 2,692,054 | 10/1954 | Berglund | 248/303 X |
| 2,842,264 | 7/1958 | Larson | 248/DIG. 3 X |
| 3,374,898 | 3/1968 | Karmin | 211/59 |
| 3,452,954 | 7/1969 | Lucietto et al. | 248/DIG. 3 X |
| 3,484,069 | 12/1969 | Larson | 248/DIG. 3 X |
| 3,489,382 | 1/1970 | Larson | 248/DIG. 3 X |
| 3,715,096 | 2/1973 | Filbert | 248/DIG. 3 X |
| 3,815,756 | 6/1974 | Cox | 211/57 |

*Primary Examiner*—Roy D. Frazier
*Assistant Examiner*—Thomas J. Holko
*Attorney, Agent, or Firm*—Blum, Moscovitz, Friedman & Kaplan

[57] ABSTRACT

An improved hook display assembly is provided which comprises a rack, hook members releasably connected thereto, and a safety bumper guard connected to the rack which extends beyond the free end of the hook members so as to prevent an inadvertent encounter with a hook member of the display. Also connected to the rack is a means for releasably connecting the display to a standard.

5 Claims, 11 Drawing Figures

101
103
11
110
106'
109
106
105
104
119
108
115
117'
117
120
118
10
116
102
103'
107'
108'
107

HOOK DISPLAY ASSEMBLY

BACKGROUND OF THE INVENTION

This invention relates to an improved hook display assembly and more particularly, to the safety feature provided therefor.

Packaged items, such as carded products, are conveniently displayed on a rack having a series of hanger-equipped bars or hook members. The carded products are readily removable by a customer therefor. Particularly in supermarkets and other retail outlets, these hook displays are randomly scattered through heavily trafficked areas of the store according to convenience and point of sale impact.

Frequently, these displays are at eye-level for on sight sales and easy access thereto. These supermarkets and retail outlets usually are provided with narrow aisles which are heavily trafficked. As a result, there is an extremely high incidence of injury, particularly eye injury, caused by inadvertent encounter with a hook of this type of display unit.

Accordingly, there is a need for a display unit of the type described which includes a built-in safety feature which minimizes the incidence of injury caused by the display, substantially eliminates puncture-type injuries which have been caused by this type of display in the past, and yet does not detract from the sales impact of the displayed items or appreciably hinder removal of an item from the display.

SUMMARY OF THE INVENTION

Generally speaking, in accordance with the invention, an improved hook display assembly is provided which comprises a rack, hook members releasably connected thereto, and a safety bumper guard connected to the rack which extends beyond the free end of the hook members so as to prevent an inadvertent encounter with a hook member of the display. Also connected to the rack is a means for releasably connecting the display to a standard. The safety bumper guard prevents puncture injuries which may occur as a result of an inadvertent push or shove into contact with a hook member and the safety bumper guard is provided with rounded edges and is fabricated of a resilient material so that contact therewith does not result in any serious injury.

Accordingly, it is an object of this invention to provide an improved hook display assembly in which the hooks thereof are guarded.

Another object of the invention is to provide a safety bumper guard for a hook display assembly which does not impair the sales value of the display but substantially prevents injury caused thereby.

A further object of the invention is to provide a safety bumper guard for a hook display assembly which is fabricated of resilient material and provided with rounded edges so as not to be a source of injury.

Still other objects and advantages of the invention will, in part, be obvious and will, in part, be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 2:
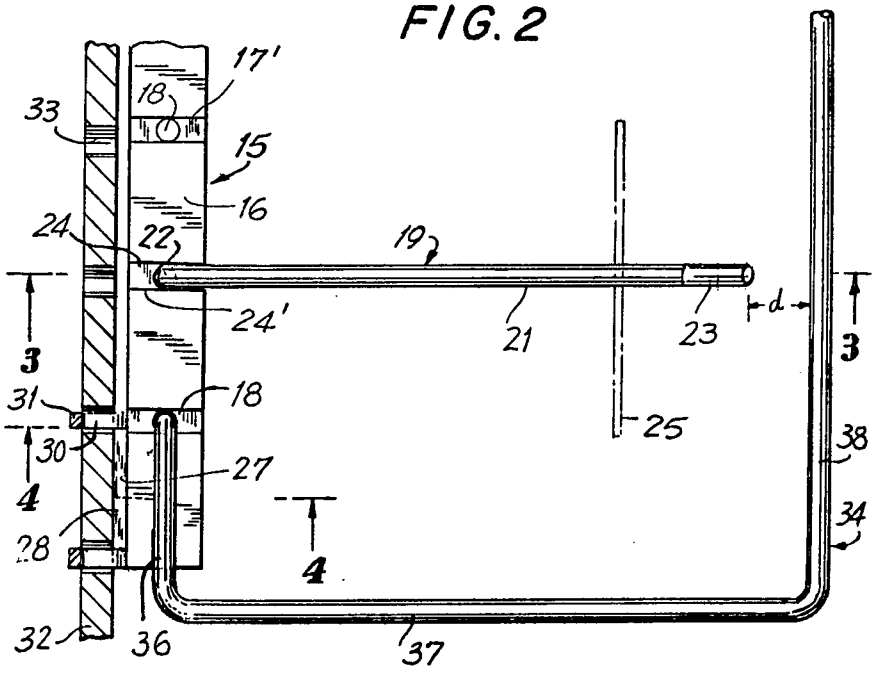
FIG. 2 is a sectional plan view of the embodiment shown in FIG. 1 taken along line 2—2 thereof.
Figure 3:
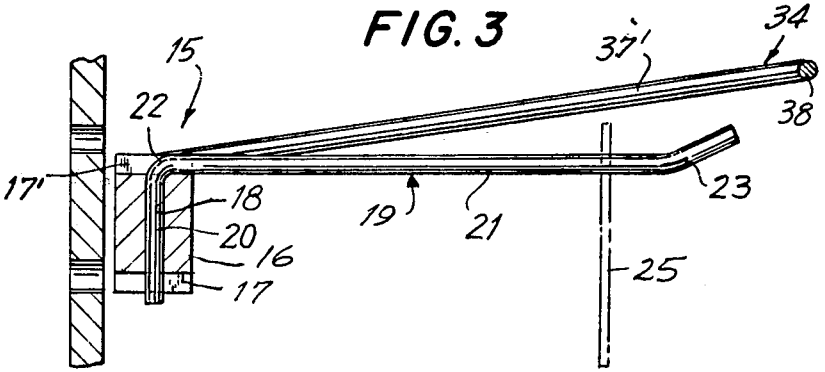
FIG. 3 is a sectional view of the embodiment shown in FIG. 2 taken along line 3—3 thereof.

Referring now to the drawings, like parts are designated by the same numeral. Referring particularly to FIGS. 1–8, a hook display assembly, generally designated by the numeral 15, includes a rack 16 having a substantially rectangular cross-section and provided with a plurality of aligned undercut and overcut notches, respectively, 17 and 17′. Respective notches 17 and 17′ are spaced a predetermined distance one from the other and in parallel. Each notch 17 is aligned with a notch 17′. A through hole 18 is provided in each notch 17′ and extends widthwise through rack 16 into an aligned notch 17. Each through hole 18 is provided at a substantially intermediate portion of respective notches 17′ and 17. Into each through hole 18, a hook member 19 is releasably connected.

Each hook member 19 includes a shank portion 20 which is adapted to extend through a through hole 18, a stem portion 21 integrally connected at one end to shank portion 20 at an elbow 22 and having an offset free end 23. The offset angle between end 23 and stem 21 is acute. When the shank portion 20 of hook member 19 is inserted into through hole 18, the side walls 24 and 24′ of notch 17′ restrict the placement of hook member 19 and substantially prevent reciprocal movement thereof on shank 20. Elbow 22 defines the length of hook member 19 which extends into through hole 18. Onto offset end 23, a plurality of carded products 25 may be introduced onto hook member 19. For instance, each card 25 may be provided with an aperture 26 which is registrable with end 23 and hook member 19. Once suspended from hook member 19, offset end 23 prevents accidental removal of card 25 therefrom.

Referring particularly to FIGS. 1–4, to the rear surface 27 of rack 16, a pair of braces 28 and 28′ are releasably connected as by means of screws 29 and 29′ which are respectively threadably connected thereto. Braces 28 and 28′ are respectively releasably connected to remote ends of rack 16. Each brace respectively includes a pair of tabs 30 and 30′. Each tab 30 and 30′ is formed with a hook portion 31 and 31′ which is adapted to engage the back of a peg board 32 in the manner shown to prevent respective tabs 30 and 30′ from being inadvertently pulled out of the peg board apertures 33 into which they are removably connected.

Figure 1:
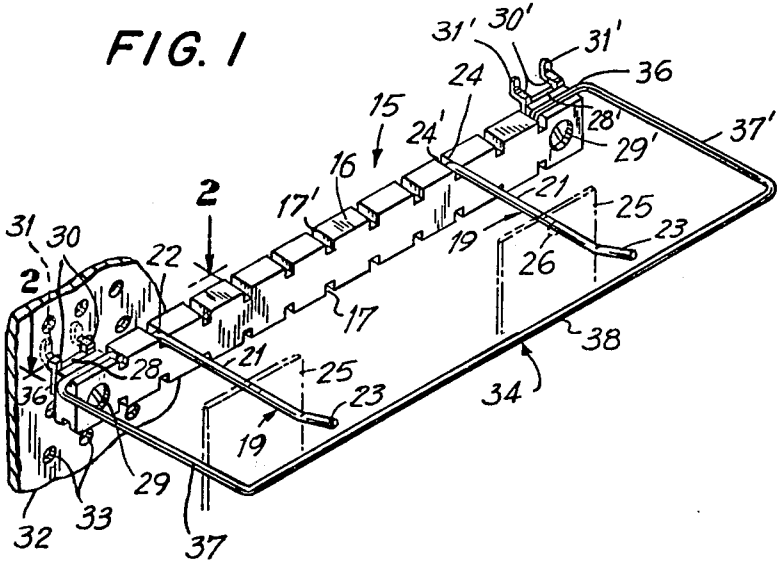
FIG. 1 is a perspective view of a peg board mounted hook display assembly constructed in accordance with the invention.
Figure 4:
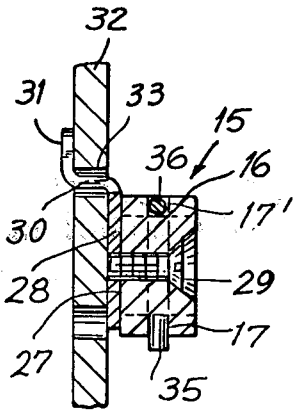
FIG. 4 is a detail view taken along line 4—4 of FIG. 2 illustrating a means for mounting the display assembly on a peg board.

Referring generally to FIGS. 1–8, a bumper guard 34 is releasably connected to rack 16. As best seen in FIGS. 1, 2 and 4, bumper guard 34 includes a pair of shank portions 35 and 35′ (not shown) engageable in respective through holes 18 provided in remote notches 17′ of rack 16, and a pair of opposed outwardly turned shoulders 36, 36′ overlying respective opposite end portions of rack 16 and extending respectively therebeyond. From shoulders 36, 36′ issue a pair of inwardly turned substantially parallel arms 37, 37′ to which a cross member 38 is connected. Arms 37 and 37′ extend substantially parallel to mounted hook members 19 and somewhat beyond the offset ends 23 thereof, for instance, a distance *d*, for thereby arranging cross member 38 perpendicularly relative to hook members 19 and a distance *d* therefrom. The body portion of bumper guard 34 consisting of shoulders 36, 36′, arms 37, 37′ and cross member 38 is substantially coplanar with mounted hook members 19.

The distance between offset ends 23 of hook members 19 provides a packing or removal space for introducing or withdrawing a carded item 25 onto or from hook member 19. While providing for ready introduction and removal of carded items, bumper guard 34 prevents injury against hook members 19 due to an accidental fall into display assembly 15. Bumper guard 34 is preferably resilient and flexes in the cross member portion 38 thereof in response to an impact thereagainst, but not more than distance *d* so as to prevent impalement upon hook members 19. If bumper guard 34 is rigid an impact thereagainst may result in severe concussive injury. Therefore, it is deemed a significant feature of the invention that at least cross member portion 38 of bumper guard 34, the portion of bumper guard 34 which is most prominently displayed have a predetermined elastic character.

With general reference to the display assemblies seen in the Figures, the bumper guard 34 is employed in connection therewith and forms an integral part thereof. Referring generally to FIGS. 5–8, the hook display assemblies illustrated therein differ from the embodiment seen in FIGS. 1–4, only in that alternate means for releasably connecting the display to a standard are employed.

Figure 5:
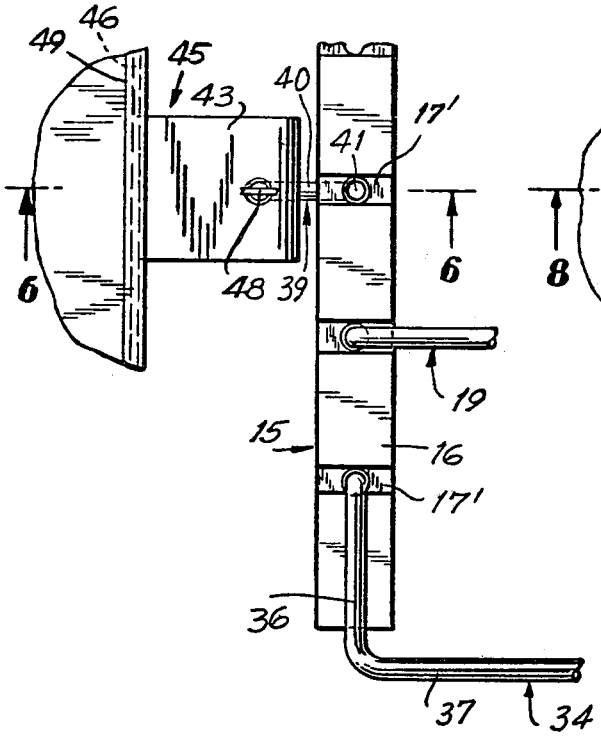
FIG. 5 is a fragmentary plan view of the embodiment shown in FIG. 1 wherein another means is employed for connecting the display assembly to a standard.
Figure 6:
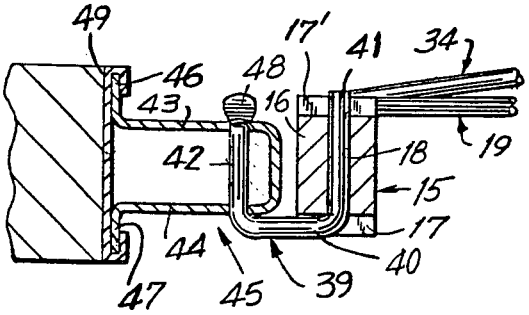
FIG. 6 is a sectional view of the embodiment shown in FIG. 5 taken along line 6—6 thereof to more particularly illustrate the alternate connection means.

Referring now to FIGS. 5 and 6, a U-shaped support 39 includes a base portion 40 and upstanding legs 41 and 42 issue therefrom. Leg 41 is received by through hole 18 and base portion 40 thereof partially interfits within notch 17 for thereby supporting rack 16 on support 39. Side walls of notch 17 prevent reciprocal movement of rack 16 relative to support 39. Leg 42 is journalled through respective side walls 43 and 44 of field clip 45 which terminates in upper and lower outwardly turned flanges 46 and 47. The free end of leg 42 is blunted to prevent leg 42 from disconnecting from its journalled in position in field clip 45 under the weight of display assembly 15. A channel member 49 is provided, for instance, on an edge of a gondola of the type common to supermarkets and retail outlets and upper and lower flanges, respectively 46 and 47 are interfitted therein for thereby supporting hook display assembly 15. One or more of these mounting means may be releasably connected to rack 16 for thereby supporting the unit. To disconnect hook display assembly 15 from the mounting, rack 16 may be lifted upwardly until it is free of leg 41 of U-shaped support 39.

Figure 7:
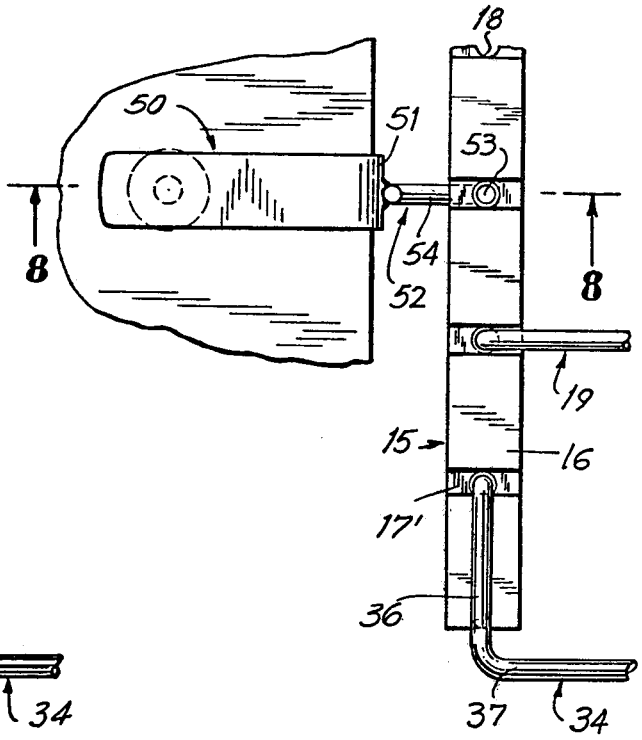
FIG. 7 is a fragmentary plan view of the embodiment shown in FIG. 1 including yet another alternative connection means for connecting the display assembly to a standard.
Figure 8:
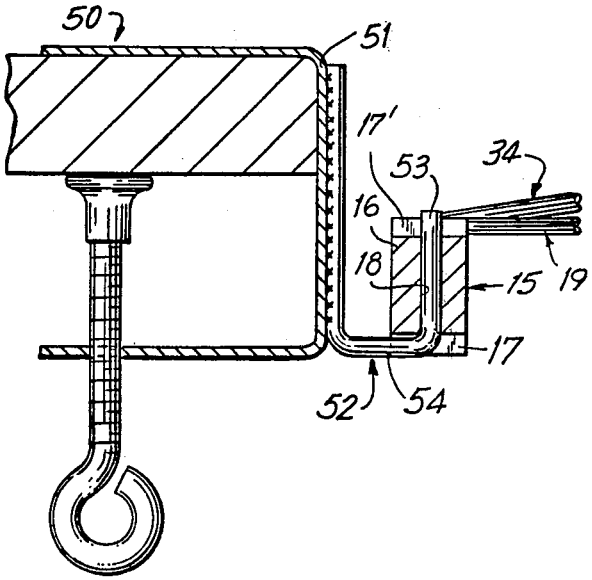
FIG. 8 is a sectional view of the embodiment shown in FIG. 7 taken along line 8—8 thereof which shows in detail the other alternative connection means.

Referring now to FIGS. 7 and 8, a clamp 50 is releasably connected to a shelf, for instance, of a gondola and includes a web 51 to which an L-shaped support 52 is connected. Leg 53 of L-shaped support 52 is received in a through hole 18 of rack 16 and the base portion thereof 54 is confined within a notch 17 for supporting display assembly 15 on support 52 and preventing reciprocal movement thereof relative to support 52. Display assembly 15 is releasably connected to support 52 and may be disconnected therefrom by lifting rack 16 upwardly until free of leg 53.

Figures 9, 10, 11:
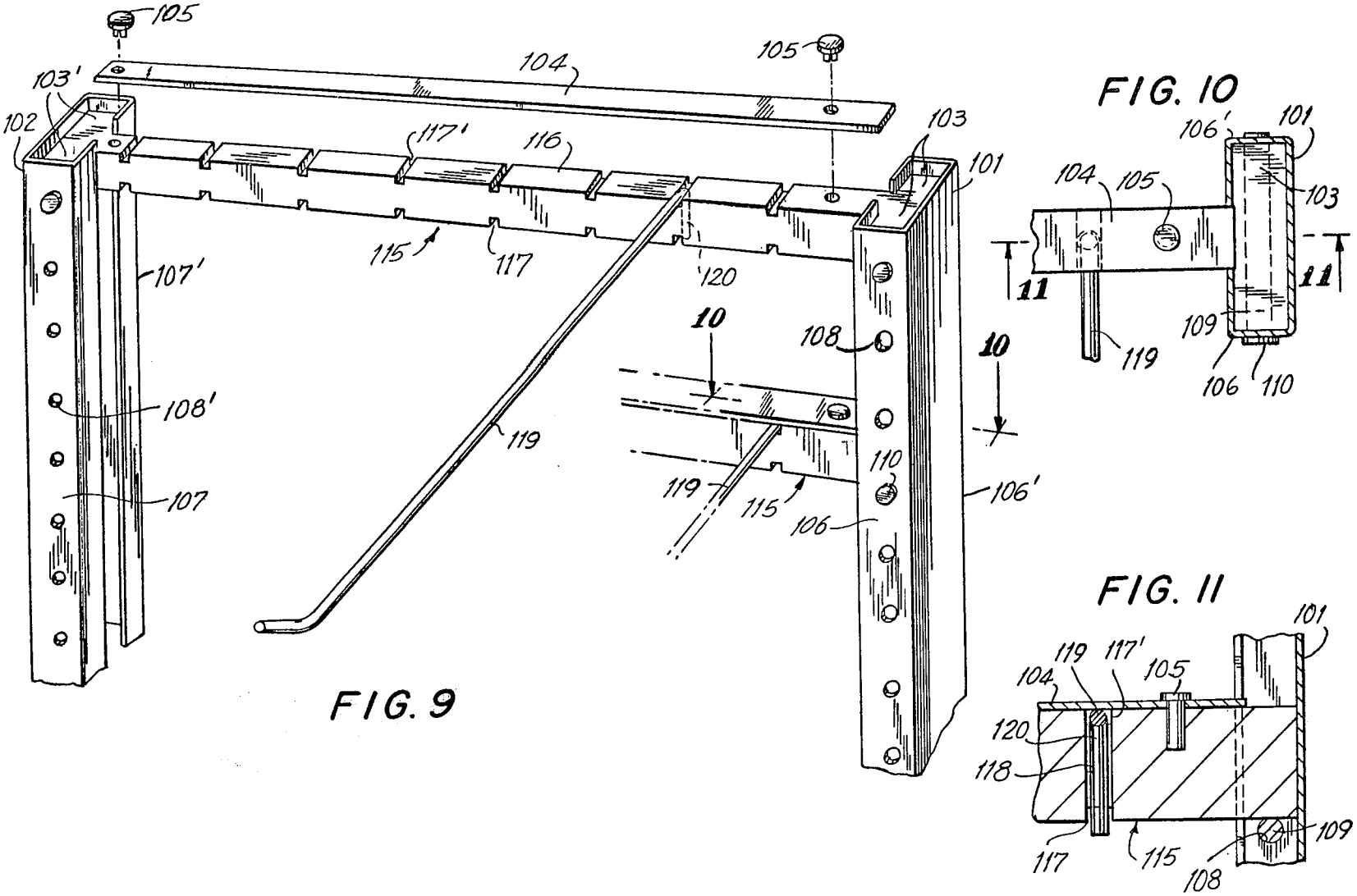
FIG. 9 is a perspective view of a vertically adjustable hook display assembly constructed in accordance with the invention.
FIG. 10 is a sectional view of the embodiment shown in FIG. 9, taken along line 10—10 thereof.
FIG. 11 is a sectional view of the embodiment shown in FIG. 10, taken along line 11—11 thereof.

Referring now to FIGS. 9–11, a vertically adjustable hook display assembly 115 is slidably connected to a pair of substantially parallel upright channels 101 and 102 by means of respective pairs of bosses 103 and 103′ which respectively interfit within channels 101 and 102. Hook display assembly 115 includes a rack 116 provided with undercut and overcut notches, respectively 117 and 117′ which are aligned and include a through hole 118 therein for receiving the shank portion 120 of a hook member 119. Overlying the top surface of rack 116 is a plate 104 threadably connected thereto by screws 105 for preventing withdrawal of hook member 119 from its mounting in rack 116.

Respective webs 106, 106′ and 107, 107′ of upright channels 101 and 102 include respective pluralities of aligned apertures 108 and 108′. Respective apertures in webs 106 and 106′ and 107 and 107′ are aligned to receive a rod 109 therethrough provided at one end thereof with a head 110. The respective positions of a pair of rods 109 respectively set in channels 101 and 102 determines the position of hook display assembly 115. The vertical height of display assembly 115 may be selected according to the predetermined positions of a respective pair of rods 109 in upright channels 101 and 102.

In all of the aforementioned embodiments, it is intended that a bumper guard 34 will be used in connection therewith. The bumper guard 34 renders the device safe for use in high population density retail stores and does not detract from the usefulness thereof.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved hook display assembly for displaying carded items for sale which comprises a rack, said rack having a substantially rectangular cross-section and respective pluralities of aligned undercut and overcut notches and a through hole provided in each overcut notch extending widthwise through said rack into an aligned undercut notch, at least one hook member releasably connected at one end thereof to said rack and having another free end, said at least one hook member being arranged perpendicularly relative to said rack, said at least one hook member including a shank portion adapted to extend into a through hole provided in said rack, a stem portion integrally connected at one end to said shank portion at an elbow and an offset free end, the offset angle between said free end and said stem being acute, and a safety bumper guard releasably connected to said rack and extending beyond said free end of said at least one hook member so as to prevent an inadvertent encounter with said at least one hook member of said display, said bumper guard being releasably connected to said rack and comprising a pair of shank portions engageable in respective through holes provided in remote notches of said rack, a pair of opposed outwardly turned shoulders arranged to overlie respective opposite end portions of said rack and extending respectively therebeyond, a pair of inwardly turned substantially parallel arms issuing from said respective shoulders and a cross member connected at each end thereof to a respective arm.

2. The hook display assembly as claimed in claim 1 including a means for releasably connecting said hook display assembly to a standard.

3. The hook display assembly as claimed in claim 1, said arms extending substantially parallel to said at least one hook member and somewhat beyond said offset end thereof, said cross member thereby being arranged perpendicularly relative to said at least one hook member and a distance *d* therefrom, said bumper guard being substantially coplanar with said at least one hook member.

4. The hook display assembly as claimed in claim 3 wherein said bumper guard has a resilient character and flexes in at least said cross member portion thereof in response to an impact, but not more than said distance *d* so as to prevent impalement upon said at least one hook member.

5. The hook display assembly as claimed in claim 1, including a pair of braces releasably connected to respective remote ends of said rack, each of said braces including a pair of tabs, each tab being formed with a respective hook portion adapted to engage the back of a peg board.

* * * * *